US010072411B1

(12) United States Patent
Moran et al.

(10) Patent No.: US 10,072,411 B1
(45) Date of Patent: Sep. 11, 2018

(54) MODULAR PANELS AND RELATED ELEMENTS TO FORM A VARIETY OF WALL SEGMENTS AND ENCLOSURES

(71) Applicant: MCCAIN MANUFACTURING, INC., Vista, CA (US)

(72) Inventors: Thomas Moran, Vista, CA (US); Stephany Lugardo, Vista, CA (US); Donald Martin Engh, Vista, CA (US)

(73) Assignee: MCCAIN MANUFACTURING, INC., Vista, CA (US)

( * ) Notice: Subject to any disclaimer, the term of this patent is extended or adjusted under 35 U.S.C. 154(b) by 0 days.

(21) Appl. No.: 15/625,156

(22) Filed: Jun. 16, 2017

(51) Int. Cl.

| | |
|---|---|
| ***E04B 1/343*** | (2006.01) |
| ***E04B 1/41*** | (2006.01) |
| ***E04B 1/61*** | (2006.01) |
| ***E04H 1/12*** | (2006.01) |

(52) U.S. Cl.
CPC ..... *E04B 1/34321* (2013.01); *E04B 1/40* (2013.01); *E04B 1/61* (2013.01); *E04H 1/1272* (2013.01); *E04B 2001/6195* (2013.01)

(58) Field of Classification Search
CPC ..... E04B 1/34321; E04B 1/40; E04B 1/61; E04B 2001/6195; E04B 1/18; E04B 1/2403; E04B 1/08; E04H 1/1272; E04C 2/08
USPC ..... 52/506.01, 300, 91.1
See application file for complete search history.

(56) References Cited

U.S. PATENT DOCUMENTS

| | | | | |
|---|---|---|---|---|
| 817,508 A | | 4/1906 | Niele | |
| 1,229,478 A | | 6/1917 | Kramer | |
| 2,023,814 A | | 12/1935 | Lindsey | |
| 2,365,175 A | | 12/1944 | Crawford | |
| 3,031,044 A | | 4/1962 | Stitt et al. | |
| 3,195,735 A | * | 7/1965 | Jay | A47B 57/402 211/182 |
| 3,353,318 A | * | 11/1967 | Bacher | E04B 1/6813 49/498.1 |
| 3,568,388 A | * | 3/1971 | Flachbarth et al. | E04B 2/72 52/241 |
| 3,657,849 A | | 4/1972 | Garton | |
| 3,755,975 A | | 9/1973 | Herzer et al. | |
| 3,777,430 A | * | 12/1973 | Tischuk | E04C 2/292 52/309.9 |
| 3,996,712 A | * | 12/1976 | Howell | E04B 2/72 52/241 |
| 4,099,021 A | | 7/1978 | Venezia | |
| 4,165,944 A | * | 8/1979 | Sunasky | A47B 57/402 403/254 |
| 4,221,087 A | * | 9/1980 | Lowe | E04B 1/08 52/281 |
| 4,267,679 A | * | 5/1981 | Thompson | E04C 2/292 52/478 |

(Continued)

FOREIGN PATENT DOCUMENTS

EP 611853 A1 * 11/1994

*Primary Examiner* — Brent W Herring
(74) *Attorney, Agent, or Firm* — The Maxham Firm

(57) ABSTRACT

A modular panel and component system from which a variety of wall segments, wall structures, and enclosures may be rapidly assembled, and disassembled. In addition to the wall panels, interior finish panels are adapted to be hung from rails secured laterally to the inside of adjacent wall panels. The system also preferably includes door assemblies and ancillary brackets and hardware to facilitate the assembly of the contemplated wall structures and enclosures.

16 Claims, 22 Drawing Sheets

(56) References Cited

U.S. PATENT DOCUMENTS 4,291,510 A 9/1981 Sivachenko
4,561,233 A * 12/1985 Harter ..... E04F 13/12 52/506.1
4,712,336 A 12/1987 Backer
5,526,628 A 6/1996 Knudson
6,076,308 A * 6/2000 Lyon ..... A47B 21/00 52/239
6,145,263 A * 11/2000 Eckerd ..... E04B 1/08 52/284
6,834,468 B1 * 12/2004 Kroie ..... B32B 15/12 52/309.9
6,889,475 B2 5/2005 De Zen
6,901,708 B1 6/2005 Powers, III
7,356,970 B1 * 4/2008 Frobosilo ..... E04B 1/08 52/261
7,603,821 B2 * 10/2009 Eberlein ..... E04B 2/7425 52/238.1
7,818,932 B2 * 10/2010 Eberlein ..... E04B 2/7425 52/239
8,677,708 B2 3/2014 Williams
8,925,255 B1 1/2015 Haun et al.
8,973,337 B2 * 3/2015 Hires ..... E04C 2/30 52/79.12
9,383,174 B2 * 7/2016 Phillips ..... E04C 2/38
9,567,764 B2 * 2/2017 Phillips ..... E04B 2/18
2003/0182885 A1 * 10/2003 Gresham ..... E04B 2/7425 52/242
2006/0162268 A1 * 7/2006 Eberlein ..... E04B 2/7425 52/236.9
2010/0064597 A1 * 3/2010 Eberlein ..... E04B 2/7425 52/36.5
2014/0047795 A1 * 2/2014 Hires ..... E04C 2/30 52/783.1
2015/0020468 A1 * 1/2015 Wickstrom ..... E04F 13/0816 52/274

* cited by examiner

MODULAR PANELS AND RELATED ELEMENTS TO FORM A VARIETY OF WALL SEGMENTS AND ENCLOSURES

FIELD OF INVENTION

This concept relates generally to portable, assemblable, and disassemblable wall structures which can be selectively formed as walls and as enclosures, for both permanent and temporary purposes.

DISCUSSION OF THE PRIOR ART

Assemblable walls and enclosures are useful for many purposes. They can be used to form walls and enclosures for exhibits, and to form temporary and permanent walls and enclosures for a variety of other purposes. Examples of such other purposes include walls in pedestrian areas to separate construction apparatus and personnel from people passing along the same area. Enclosures can be for offices, for temporary storage of equipment and supplies, as well as for other activities. The possibilities for uses of modular walls and enclosures are vast and varied.

In the past, temporary walls were often constructed with drywall panels. These would take several days to construct and would be relatively heavy, non-recyclable, and messy in the assembly stages. Usually such drywall structures required some finish work and final painting.

An example of a modular kit to form walls and enclosures is the subject of U.S. Pat. No. 4,712,336, entitled INTERCONNECTING "FULL BLEED" MODULAR PANEL AND CONNECTIVE HARDWARE SYSTEM TO FORM A VARIETY OF EXHIBIT AND OFFICE INTERIOR ENCLOSURES. The wall panels and the mating connector elements enable modularity so that a variety of walls and structures can be constructed with the modular elements. Another modular building related publication is U.S. Pat. No. 5,526,628, entitled WALL, ROOF AND BUILDING STRUCTURES.

Generally, temporary wall and enclosure structures are not reusable and must be demolished and disposed of. This, of course, adds to the disruption that started with the initial construction, at least for drywall units. In addition to the building and subsequent removal of such structures, there is the concept of waste resulting from a single use, and the consequent landfill additions.

SUMMARY OF EMBODIMENTS OF THE INVENTION

The concepts described herein provide great flexibility and ease of assembly which can be accomplished in hours rather than days. Further, walls and enclosures constructed with this modular system can be disassembled and used again for another similar or completely different structure. Alternatively, a wall segment or whole enclosure so constructed can be moved in fully assembled form if desired.

Modular wall panels are secured together to form the length of wall that is needed for any particular purpose. Interior finish panels are formed with specifically designed hook elements which project away from the panels. Interior finish panel rails are secured horizontally across as many of the vertically oriented wall panels as necessary to accommodate the specified interior finish panels. The interior finish panel rails have specifically designed cutouts which are easily engaged by the panel hook elements in a manner that snugs the interior finish panels to the basic wall already constructed with a plurality of adjacent wall panels to provide a wall structure that is finished on both sides. The term "interior" as used here only refers to the side of the wall opposite to the outwardly facing wall panels, which would be within the interior of an enclosure formed by the components which comprise the wall system. Walls or enclosures so constructed may be located within a building or outside a building.

There are a number of optional and useful elements which can be included in order to provide for different location specifics, or to enhance the structure. For example, when a temporary wall is to abut a building wall, a starter panel can be employed, by which wall panels are connected to the building wall.

Bottom rails can be used on which the wall panels are mounted. Similarly, top rails can be used to enhance the stability of the tops of the wall panels as well as to provide an enhanced visual finish. Where there needs to be two walls that are not planar, corner panels are used to provide the transition from one wall assembly to another, at an angle. That angle need not be 90°, although it would normally be at such a right angle.

When necessary, door assemblies which comprise doors and wall panels can be configured to provide door access from one side of a wall to another. There could be single door or double door assemblies as they may be required for any structure specified.

The system includes appropriate hardware for various purposes, as will be described below. Because the system is modularized, all panel and other positive element connections can be accomplished with metal screws or equivalent elements.

BRIEF DESCRIPTION OF THE DRAWING

The objects, advantages, and features of this modular system will be readily perceived from the following detailed description, when read in conjunction with the accompanying drawing, in which.

DETAILED DESCRIPTION OF EMBODIMENTS OF THE INVENTION

Figure 1:
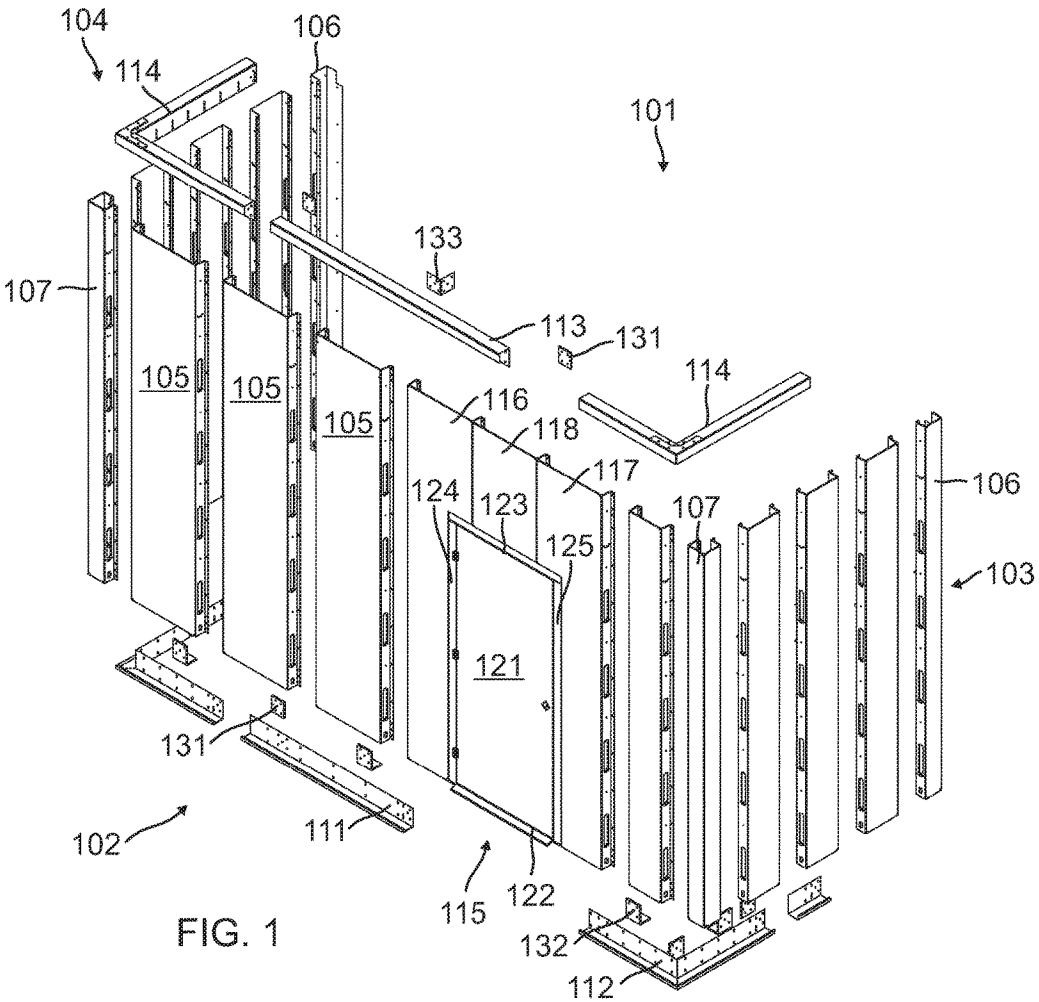
FIG. 1 is a perspective exploded view of component parts which make up a multi-panel wall configuration in accordance with an embodiment of this system.
Figure 2:
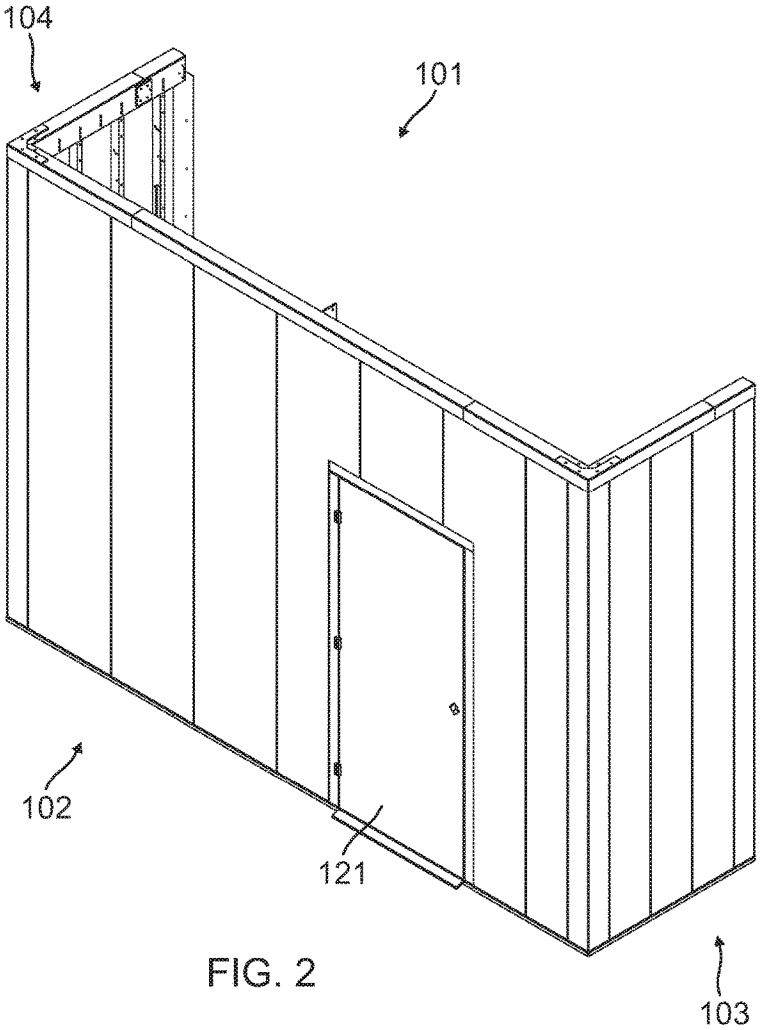
FIG. 2 is a perspective assembled view of the wall configuration of FIG. 1.

With reference now to the drawing, and more particularly to FIGS. 1 and 2, three-segment wall structure 101 is shown comprised of front section 102, right wing section 103 and left wing section 104.

As shown, front wall panels 105 are ten feet high and nominally 24 inches wide. As modular elements they could as well be eight or twelve feet high, and they could be six or 12 inches wide. These dimensions are provided for purposes of example only and promote modularity, but these panels are not so limited and they could have other dimensions.

Also included in wall structure 101 are starter panels 106, outside corner panels 107, bottom rail 111, bottom rail corner kit 112, top rail 113, top rail corner kit 114, door assembly 115, generally comprised of left single door panel 116, right single door panel 117, center single door panel 118, and door 121. The door frame is comprised of bottom single door frame panel 122, top single door frame panel 123, left single door frame panel 124, and right single door frame panel 125. It is contemplated that these members will provide as a completed assembly when specified to be part of a wall or enclosure structure.

Additional useful or ancillary members include splice bracket fastener 131, anchor mount fastener 132, and bracing plate fastener 133. These and other ancillary members will be described later.

Figure 3B:
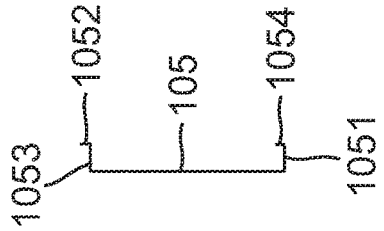
FIG. 3B is an end view of the wall panel of FIG. 3A.
Figure 3A:
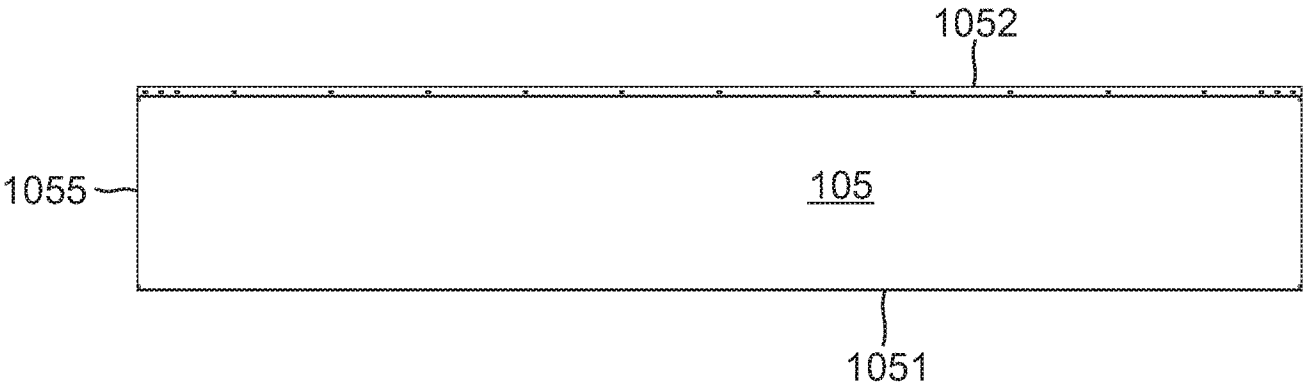
FIG. 3A is a front view of a wall panel as employed in the FIGS. 1 and 2 embodiments.
Figure 4A:
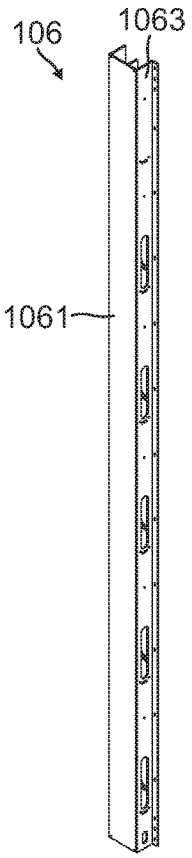
FIGS. 4A and 4D show perspective views of left and right starter panels as employed in the FIGS. 1 and 2 embodiment.
Figure 4B:
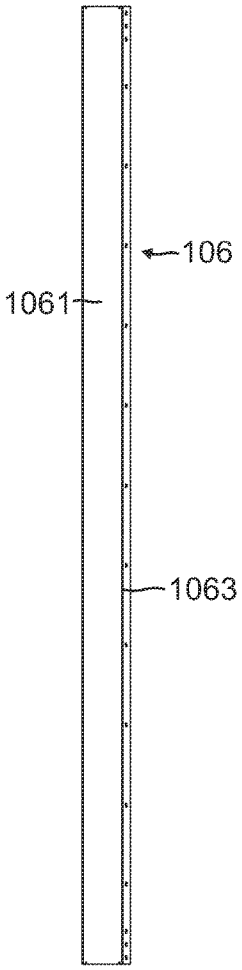
FIG. 4B is a front view of the left starter panel of FIG. 4A.
Figure 4D:
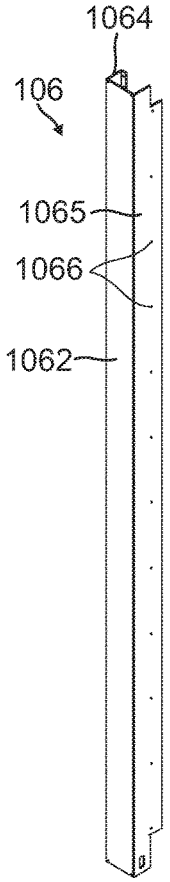
Figure 4E:
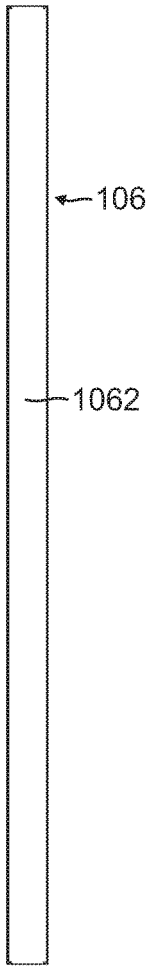
FIG. 4E is a front view of the right starter panel of FIG. 4D.
Figure 4C:
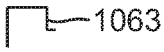
FIG. 4C is an end view of the left starter panel of FIG. 4A.
Figure 4F:
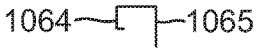
FIG. 4F is an end view of the right starter panel of FIG. 4D.

FIG. 3 is a wall panel 105 in isolation and in horizontal orientation. As stated above, the height of a wall panel is preferably eight feet, ten feet, or 12 feet, and its width is preferably six, 12, or 24 inches. These dimensions promote modularity but are not limiting. FIG. 3 shows that each long edge of the wall panel includes a full length flange. With reference to FIG. 3B, linear flange 1051 is "L" or hook shaped with an inward ridge 1054, and opposite flange 1053 is "Z" shaped with an outwardly extending ridge 1052. It can easily be seen how flanges 1051 and 1053 engage or nestle with the mating flange on an adjacent panel. When two panels are adjacent and engaged, they are firmly secured together with appropriate hardware, such as metal screws. Note that FIG. 3B appears to be a line drawing because it is an end view of what is essentially a sheet metal panel. The same is true of other end views described below. Left end 1055 in FIG. 3A is the top end, consistent with the panels shown in FIG. 1.

From FIG. 4 it can be seen that starter panel 106 is configured to engage the adjacent wall panel. Left starter panel 1061 is shaped to match with a wall panel 105 at the end of wall structure left wing 104. FIGS. 4B and 4C show the side and end views that flange 1063 is shaped to engage flange 1051 of wall panel 105. Right starter panel 1062, as shown in FIGS. 4D, 4E, and 4F, is shaped to match with a wall panel 105 at the end of wall structure right wing 103. FIGS. 4D and 4F show that flange 1064 is shaped to engage flange 1052 of a wall panel 105. The flat flange 1065 of right starter panel 1062 shows spaced holes 1066 which may be pre-drilled therein by which suitable hardware such as nails, screws, rivets and rivnuts, or the like, can be employed to secure starter panel 1062 to a wall, if that is desired. Alternatively, holes 1066 may be formed or drilled in situ as the starter panel is ready to be secured to a wall. Equivalent holes are provided in left starter panel 1061 for connecting that panel to a wall.

Figure 5A:
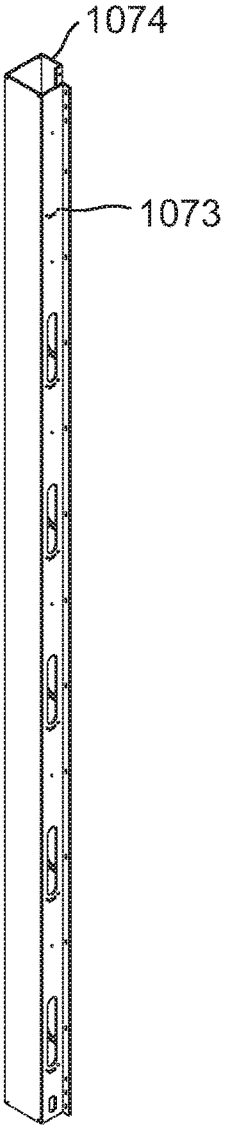
FIG. 5A is a perspective view of an outside corner panel as employed in the FIGS. 1 and 2 embodiment.
Figure 5B:
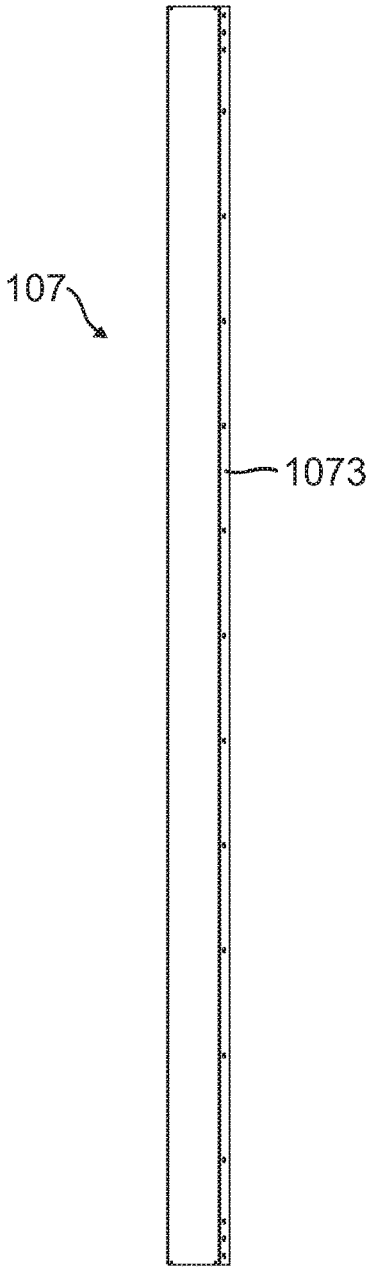
FIG. 5B is a front view of the outside corner panel of FIG. 5A.
Figure 5C:
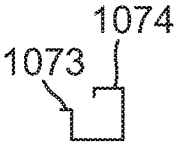
FIG. 5C is an end view of the starter panel of FIG. 5A.

Outside corner panel 107 is shown in FIGS. 5A, 5B, and 5C as it is employed in the FIGS. 1 and 2 embodiment. It can be seen that flanges 1073 and 1074 are configured to mate with the wall panels 105 on either side of a corner in the same way that a wall panel mates with similar wall panels on either side of it.

Figure 6A:
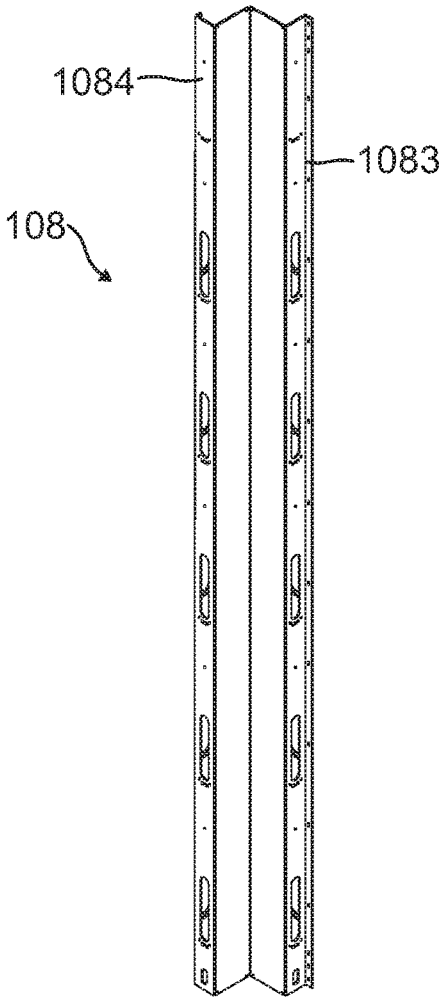
FIG. 6A is a perspective view of an inside corner panel as could be employed in the FIGS. 1 and 2 embodiment if the wall configuration had a forward angled wing.
Figure 6B:
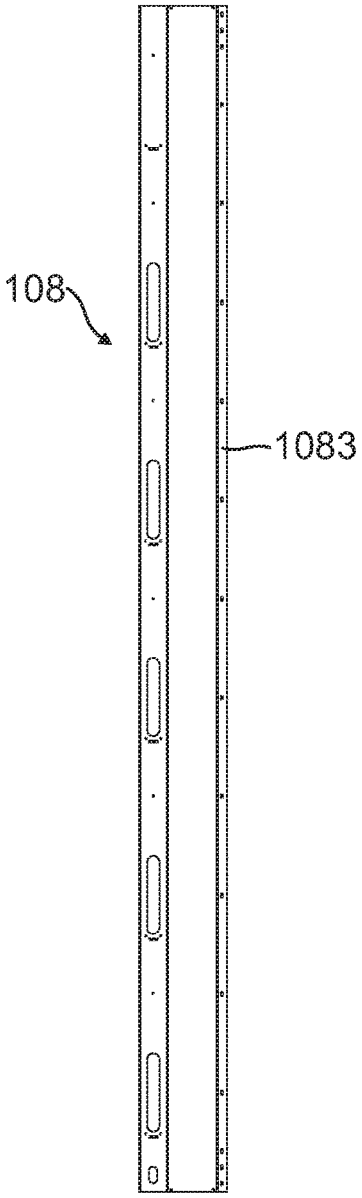
FIG. 6B is a front view of the inside corner panel of FIG. 6A.
Figure 6C:
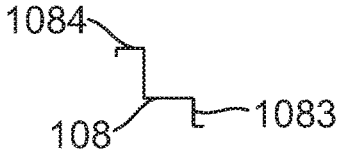
FIG. 6C is an end view of the inside corner panel of FIG. 6A.

Inside corner panel 108 is shown in FIGS. 6A, 6B, and 6C. Flange 1083 is equivalent to flange 1073 of the FIG. 5 corner panel, and flange 1084 is equivalent to flange 1074 in the FIG. 5 corner panel. This panel, of course, is used when the wall structure has an inside corner that is the primary way the wall would be viewed, opposite to the outside corner structure of FIGS. 1 and 2.

Figure 7A:
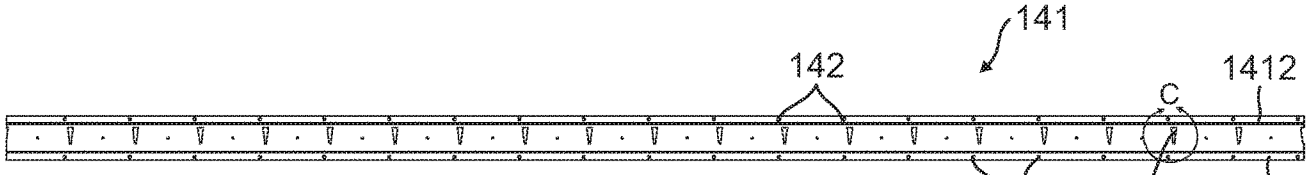
FIG. 7A is a front view of an interior finish panel rail which is configured for use with the FIGS. 1 and 2 wall system embodiment.
Figure 7B:
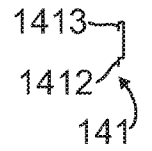
FIG. 7B is an end view of the interior finish panel rail of FIG. 7A.

The apparatus for providing a finished surface to the inside of the wall structure of FIGS. 1 and 2 is shown in FIGS. 7-9.

Finish panel rail 141 can be mounted across several wall panels 105. This rail can be attached to either or both flanges 1052 and 1054 (see FIG. 3), which may alternatively be formed with holes along the length of the mating flanges. Rail 141 has holes 142, by means of which suitable hardware, such as metal screws, secure the rail to wall panels 105. As many rails 141 may be attached to a length of a constructed wall, such as front wall section 102, as may be desired. Typically there would be at least a top, a bottom, and a middle such rail, but more or fewer rails 141 could be employed.

Figure 7C:
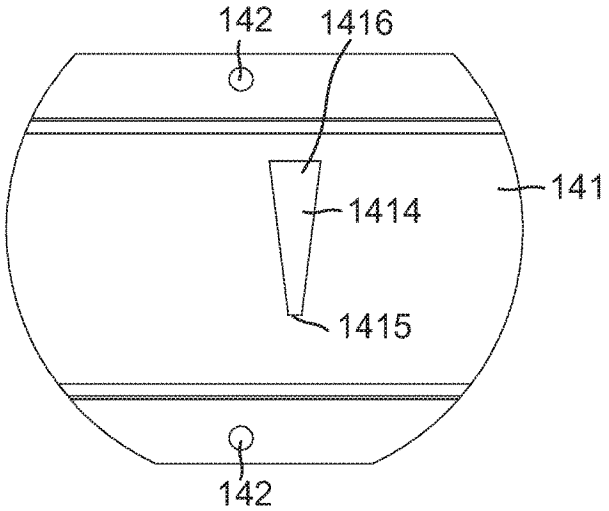
FIG. 7C is an enlarged view of a cutout in the rail of FIG. 7A.

In FIG. 7C is shown cutout 1414, which is depicted in the form of an isosceles trapezoid. This cutout has the width of slightly more than two thicknesses of a hook 152 of an interior finish panel (FIG. 8) at the bottom (narrow end) 1415, and a width at top 1416 of several times the thickness of a finish panel hook.

Figure 8D:
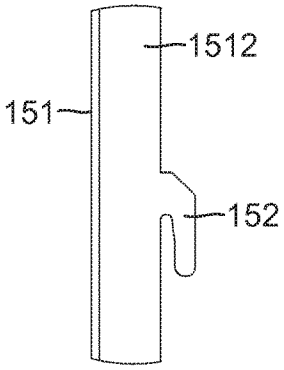
FIG. 8D is an enlarged view of a hook configured to engage a cutout of FIGS. 7A and 7C.
Figure 8B:
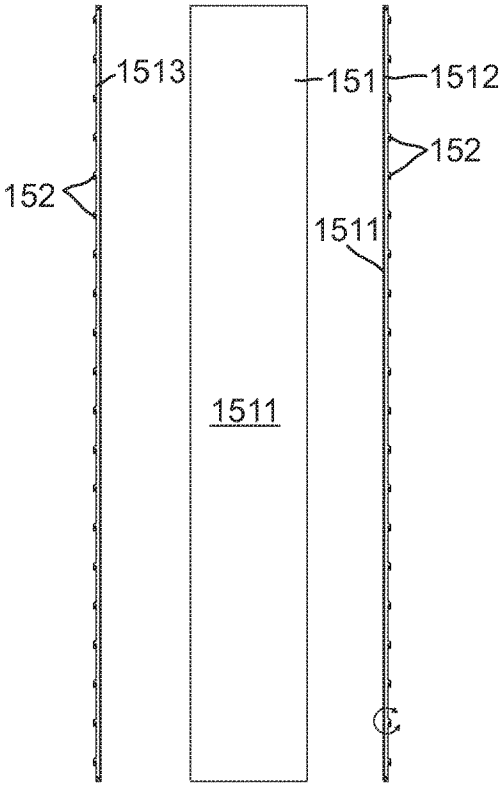
FIG. 8B is a front view, with right and left edge views of the interior finish panel of FIG. 8A.
Figure 8C:
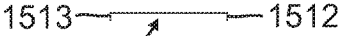
FIG. 8C is an end view of the interior finish panel of FIG. 8A.
Figure 8A:
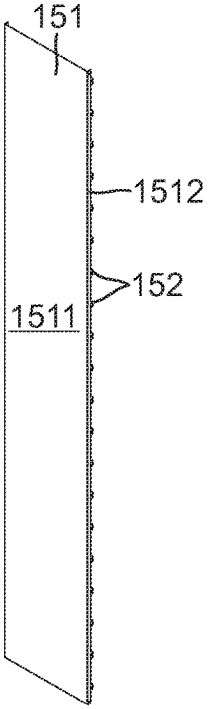
FIG. 8A is a perspective view of an interior finish panel which is configured for use with the FIGS. 1 and 2 embodiment.

FIG. 8 shows interior finish panel 151 having rearwardly (from face surface 1511) projecting flanges 1512 (right edge) and 1513 (left edge), each flange including a plurality of spaced hooks 152 (see FIG. 8C and left and right flanges 1513 and 1512, respectively). More specifically, FIG. 8A is a perspective view of interior finish panel 151. FIG. 8B is a combined figure showing a side view, and both right and left edge flanges 1512 and 1513, respectively, and a side view of hook 152 extending rearwardly from face 1511 on edge flange 1512.

Figure 9C:
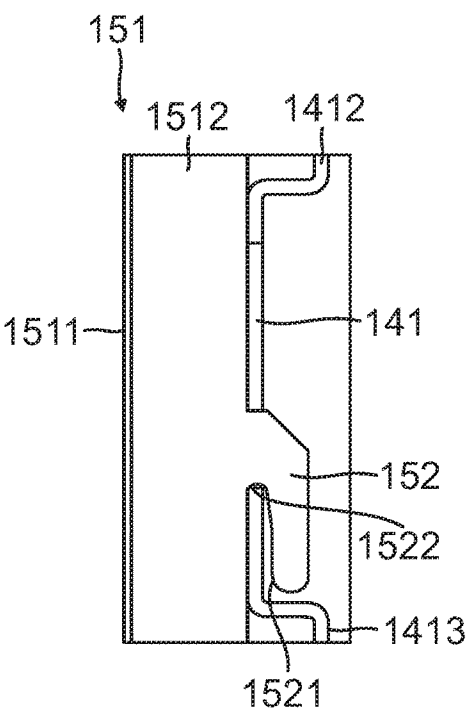
FIG. 9C is an enlarged partial side view of a hook fully engaged in a cutout of FIG. 7C.
Figure 9B:
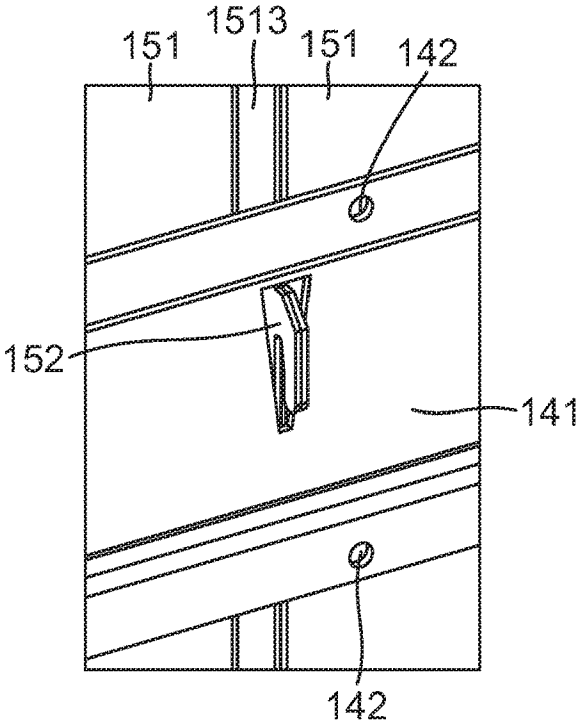
FIG. 9B is a partial isometric view of hooks of FIG. 8D and 9A partially engaged in the cutout of FIG. 7C.
Figure 9A:
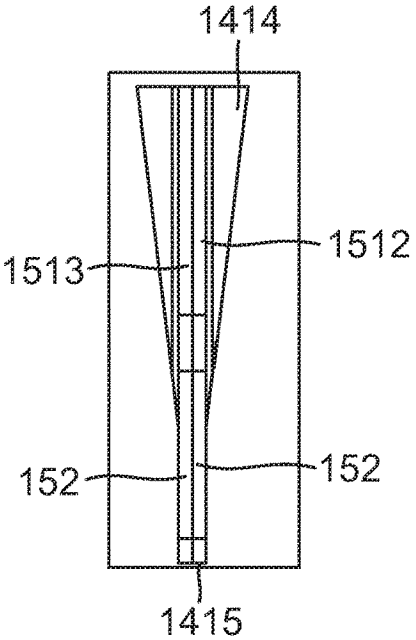
FIG. 9A is an enlarged view of a cutout of FIG. 7C engaged by the hooks of two interior finish panels of FIGS. 8A and 8C.

As is shown in FIG. 9A, cutout 1414 accommodates two facing hooks 152 projecting from two adjacent interior finish panels 151 in narrow end 1415 of the cutout. Flanges 1512 and 1513 of two abutting panels 151 share the slot in the lower portion of cutout 1414, as can be seen in FIGS. 9A and 9B.

FIG. 9C is an enlarged partial view of flange 1512 with hook 152 engaging cutout 1414 in rail 141. The rail is secured to the flanges projecting rearwardly from wall panels 105.

The shapes of cutouts 1414 and hooks 152 are purposeful. By being longer than hooks 152, and having a larger opening at end 1416, the cutouts can be easily engaged by two parallel interior finish panel hooks 152, either one at a time or simultaneously. As the panels 151 are lowered with the hooks initially projecting into the upper part 1416 in a cutout 1414, the tapered shape of the bottom portion 1415 of the cutout brings the two adjacent panels together so that flanges 1512 and 1513 of those two panels abut each other.

With reference to FIG. 9C, it can be seen that the interior surface of hook 152 is tapered so that gap 1521 is wider at the bottom opening than at blind end 1522. This shape ensures that when panel 151 engages rail 141 and when hooks 152 are fully at the lower end 1415 of cutout 1414, interior finish panel 151 is seated snugly against the rail.

The basic wall system has been described. For a more practical and complete system, a number of additional structures and elements are used. Elements which bring the wall panels more firmly together and provide a finished look are shown in FIGS. 10-13.

Figure 10B:
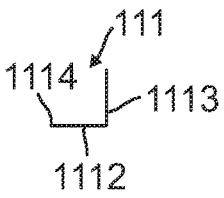
FIG. 10B is an end view of the bottom rail of FIG. 10A.
Figure 10A:
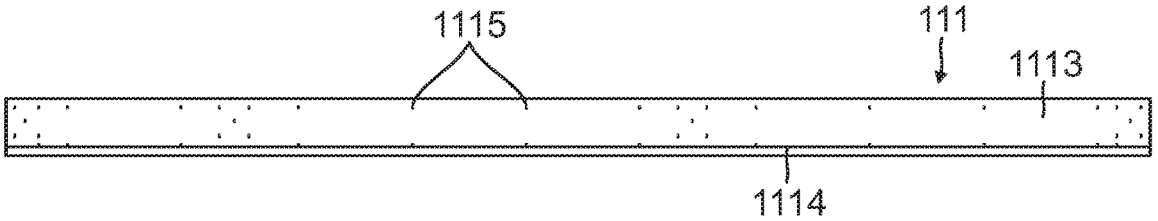
FIG. 10A is a front view of a bottom rail as can be used with the FIGS. 1 and 2 embodiment.
Figure 11:
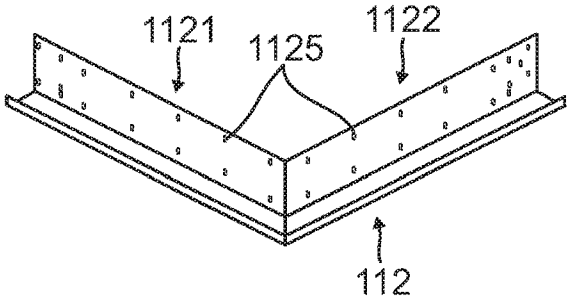
FIG. 11 is a perspective view of a bottom rail corner kit as can be used with the FIGS. 1 and 2 embodiment.

Bottom rail 111, shown in FIGS. 1 and 10, is formed with a flat, floor-contacting portion 1112, inner upright wall 1113, and outer flange 1114, detailed in FIG. 10B. To accommodate wall corners, bottom rail corner kit 112 is used and is shown in FIGS. 1 and 11. Left wing 1121 and right wing 1122 are essentially mitered portions of a bottom rail, secured together at 90°. Bottom rail corner kit 112, has the same cross-section as bottom rail 111. The left and right corner kits are the same, only rotated by 90°. The bottom rail corner kit structures may be identical, merely reoriented for a different corner.

As shown in FIGS. 1 and 10, structural wall panels 105, starter panels 106, and corner panels 107 are seated in the channel formed by flat bottom portion 1112, inner wall 1113, and outer flange 1114 of the bottom rail. Bottom rail 111 is cut to lengths as necessary to provide a mounting base for the wall panels. Alternatively, the wall panels are serially mounted in bottom rail 111 and secured together as previously described, and secured to inner wall portions 1113 of bottom rails 111 and bottom rail corner kits 112. Holes 1115 in bottom rails 111 and holes 1125 in bottom rail corner kit 112 facilitate affixing wall panels 105 to the bottom rails and corners by suitable means such as metal screws and the like.

Figure 12B:
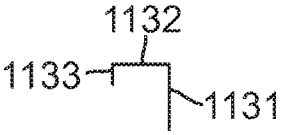
FIG. 12B is an end view of the top rail of FIG. 12A.
Figure 12A:
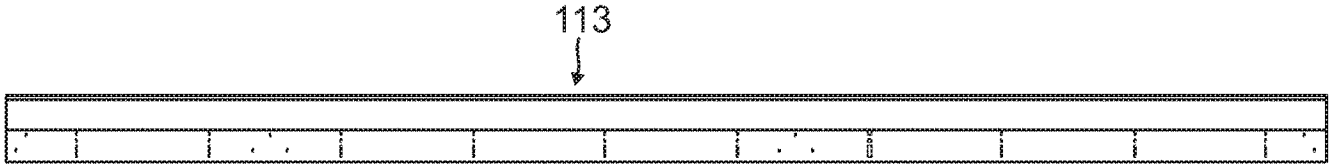
FIG. 12A is a front view of a top rail as can be used with the FIGS. 1 and 2 embodiment.

Similarly, top rail 113 is shown in FIG. 12. The top rail is, in general, a mirror image of the bottom rail, as shown in end view FIG. 12B. While not being necessary to a wall structure, the top rails offer increased stability and the look of a finished structure. The top rail has an inner wall portion 1131, a flat top portion 1132, and an outer flange 1133, thereby creating a channel in which the tops of wall panels 105, corner panels 107, and starter panels 106 reside.

Figure 13:
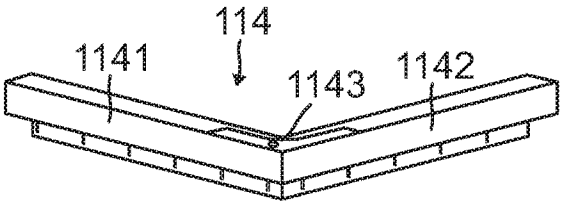
FIG. 13 is a perspective view of a top rail corner kit as can be used with the FIGS. 1 and 2 embodiment.

To accommodate wall corners, top rail corner kit 114 is used, as shown in FIGS. 1 and 13. Left main wing 1141 and right wing 1142 are secured together at 90°, preferably with corner bracket 1143.

The top rails and top rail corner kits are preferably prepared with holes by which they may be secured to the tops of wall panels 105, respectively, by suitable means such as metal screws or any of the other hardware connecting elements listed previously.

Figure 14B:
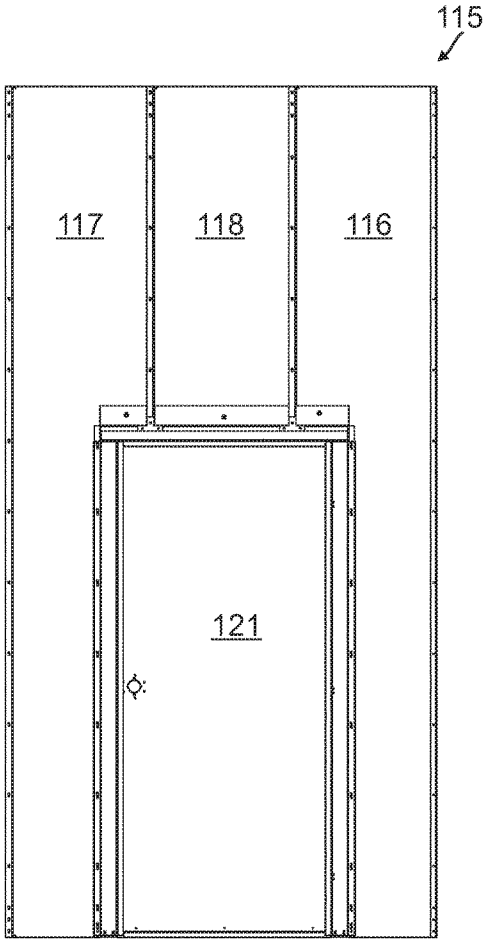
FIG. 14B is a back side view of the single door assembly of FIG. 14A.
Figure 14A:
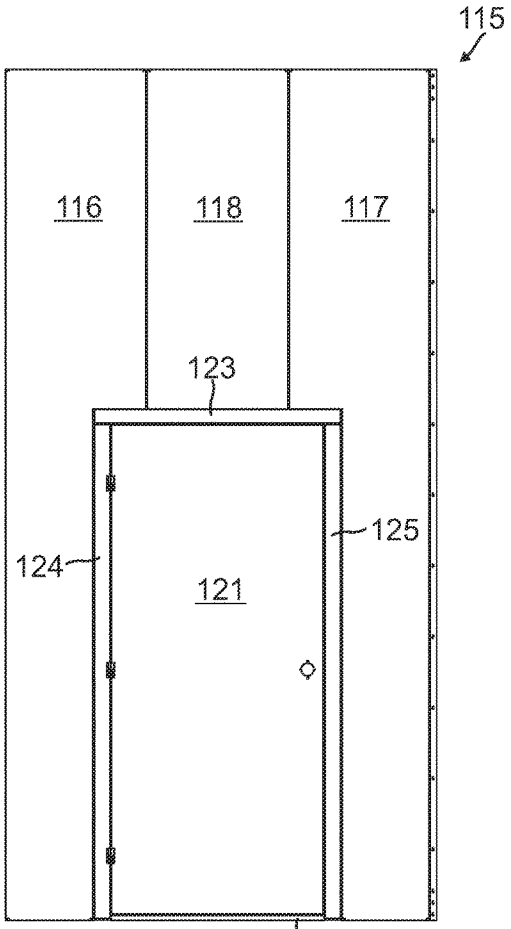
FIG. 14A is a front view of a single door assembly as shown in FIGS. 1 and 2.
Figure 15B:
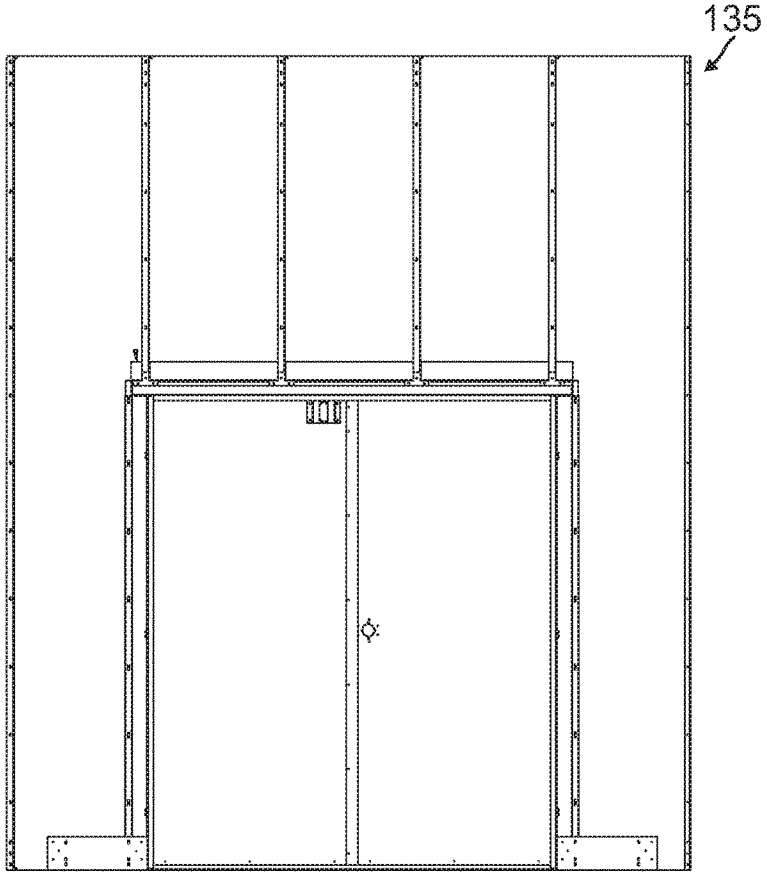
FIG. 15B is a back side view of the double door assembly of FIG. 15A.
Figure 15A:
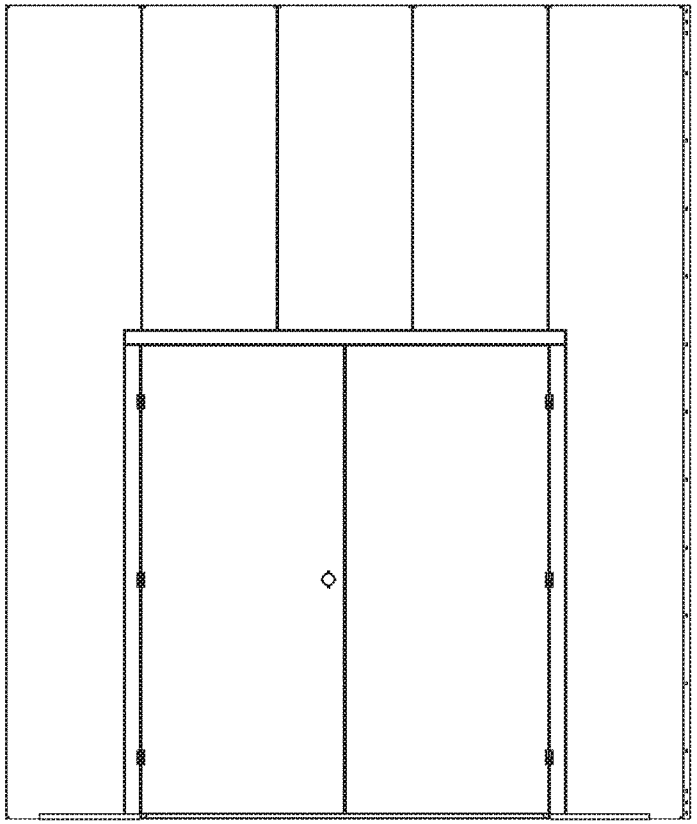
FIG. 15A is a front view of a double door assembly as can be used with the wall system of FIG. 1.

Another option, but likely to be requested by the user, is the single door assembly 115 as shown in FIG. 14. An alternative is the double door assembly 135 shown in FIG. 15.

Panels 116, 117, and 118 are typically modifications of basic wall panels 105. Left door panel 116 would normally be the same width and height as adjacent wall panel 105, modified to accommodate the left side of the door and left single door panel 124. Panel 117 has a similar shape, in mirror image, and center single door panel 118 is effectively a short segment of a wall panel 105.

Top door frame panel 123 and bottom door frame panel 122, as well as left and right single door frame panels 124 and 125, respectively, are not shown in detail because, as contemplated, the single and double door assemblies are provided as optional modular units which can be incorporated into a wall structure 101 (FIGS. 1 and 2).

While a three section wall panel system is shown in FIG. 1, the modular elements shown can be used to form a single, linear wall, which can be free standing or can be attached to walls at one or at each end. Additionally, this system can be employed to form a wall or a fully enclosed room with a door, for example, and the wall or enclosure can be portable or free standing and not anchored to a floor, wall, or ceiling.

Returning to FIG. 1, splice bracket fastener 131 may be used, together with hardware (metal screws, for example) as mentioned elsewhere herein, to secure together two ends of adjacent bottom rails or top rails. Anchor or floor mount fasteners 132 may be used to secure bottom rails and bottom rail corner kit assemblies to the floor, if needed. Bracing plate fasteners 133 may be used to secure the top rails and top rail corner kit assemblies to the ceiling, if needed or desired. Several of these elements are shown in FIG. 1 as examples. Not all of them are identified with reference numerals. A person or ordinary skill in this field of endeavor would not need to have explicit directions as to which or how many of these elements they would use or exactly how to use them.

Figure 16:
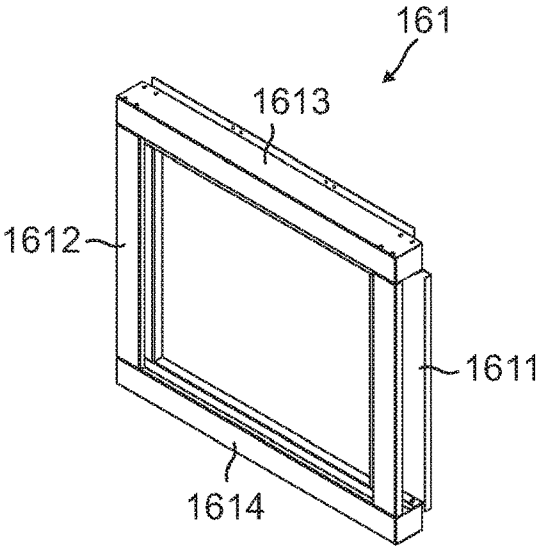
FIG. 16 is a perspective view of a window module that can be incorporated into the wall system embodiment of FIGS. 1 and 2.

Another option is a window 161 as shown in FIG. 16. This could have the same width as a wall panel and would connect with adjacent wall panels in the same way that adjacent wall panels are connected to each other. More specifically, window frame member 1611 would be connected to the mating edge of a wall panel 105 and window frame member 1612 would be connected to the opposite edge of another wall panel 105. Wall panel segments are cut to size so that an upper wall panel segment can be connected to upper window frame member 1613 and a lower wall panel segment can be connected to lower window frame member 1614. The connections would normally be by means of screws or rivets, for example, as described for other connections.

Figure 17:
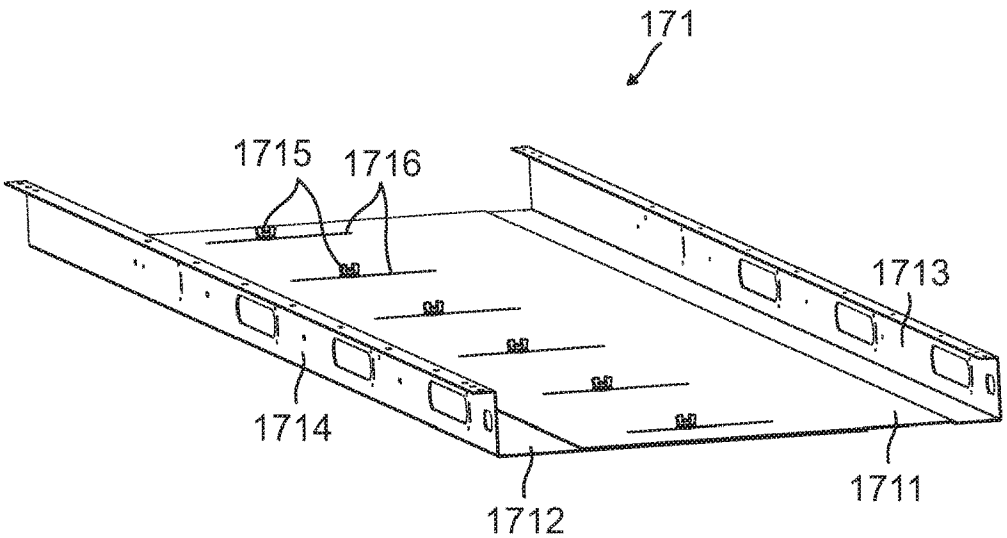
FIG. 17 is a perspective view of the back side of an adjustable horizontal sliding panel assembly that can be employed with the FIGS. 1 and 2 embodiment.

Horizontal sliding panel 171 is shown in FIG. 17. It is noted that the modular widths of wall panels 105 are anticipated to be six, 12, and 24 inches. In situations where the smallest space between panels is less than six inches, sliding panel 171 can be used to replace a wall panel 105 which has a nominal 12 inch width in a space which is 17 inches wide, for example. Panel element 1711 is mated with panel element 1712 and those two panel elements may be slidingly secured together with Pem inserts, comprised of cylinders with threads. "Pem" is a registered trademark of PEM Management, Inc., of Wilmington, Del. As shown here, the Pem inserts are mounted in panel element 1712 and project through slots 1716 in panel element 1711.

As used on the job site, one panel member, 1711 for example, is fastened to a panel 105, where flange 1713 mates with flange 1053 of the wall panel (see FIG. 3). Panel element 1712, to which the Pem inserts are mounted, is then slid to engage the next adjacent panel 105 so that flange 1714 mates with flange 1051 of that wall panel. Panels 1711 and 1712 are then secured together with wingnuts 1715 which engage the threaded portion of the Pem inserts which extend through slots 1716 in panel element 1711.

A component which lends additional flexibility to the entire system is the variable angle corner panel assembly of FIGS. 18 and 19. Outside corner assembly 181 is shown in FIG. 18A and inside corner assembly 182 is shown in FIG. 18C.

Figure 18B:
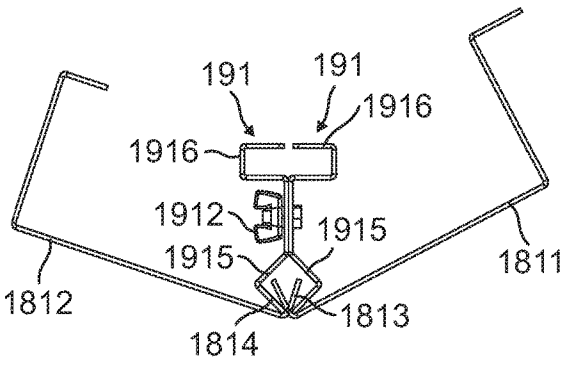
FIG. 18B is an end view of the assembly of FIG. 18A.
Figure 18C:
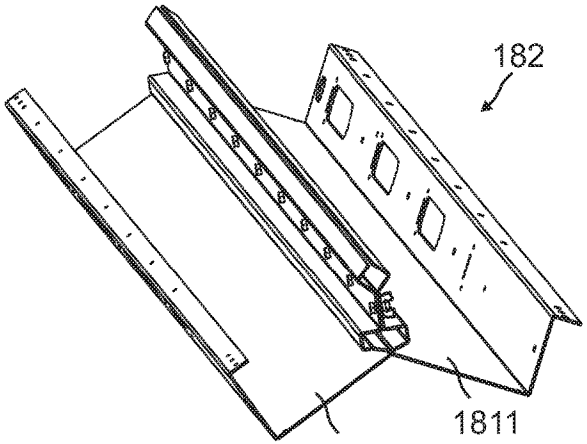
FIG. 18C is a perspective view of an inside variable angle corner panel assembly.
Figure 18A:
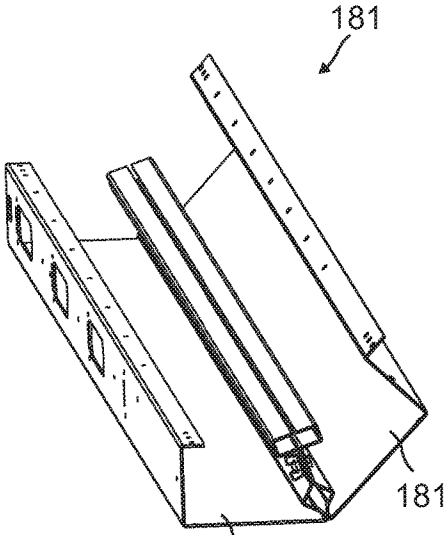
FIG. 18A is a perspective view of an outside variable angle corner panel assembly.
Figure 18E:
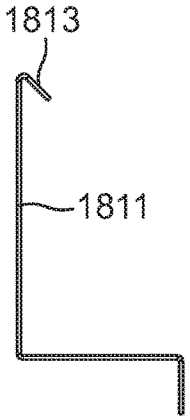
FIG. 18E is an end view of one of the panel elements shown in FIGS. 18A and 18C.
Figure 18D:
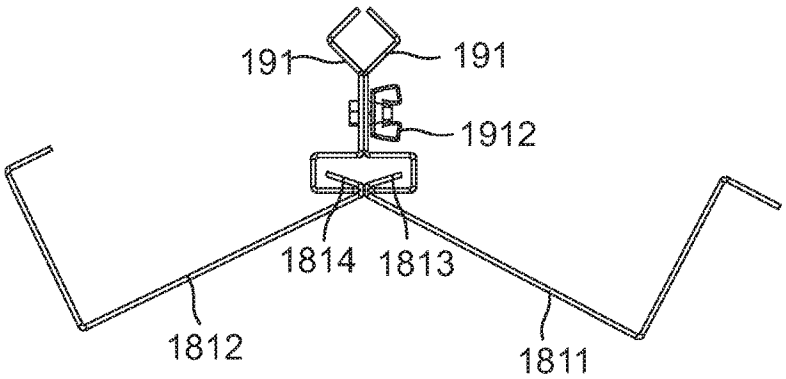
FIG. 18D is an end view of the assembly of FIG. 18C.

These assemblies are shown in end views in FIGS. 18B and 18D, respectively.

Figure 18F:
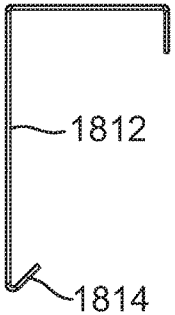
FIG. 18F is an end view of the other panel element shown in FIGS. 18A and 18C.

The shape of each corner panel is evident from FIGS. 18A and 18C. Panel 1811 of outside corner assembly 181 is shown in end view in FIG. 18E and panel 1812 of outside corner assembly 181 is shown in FIG. 18F. It should be noted that panels 1811 and 1812 are used for both the outside and the inside corners of FIGS. 18A and 18C, respectively.

Figure 19B:
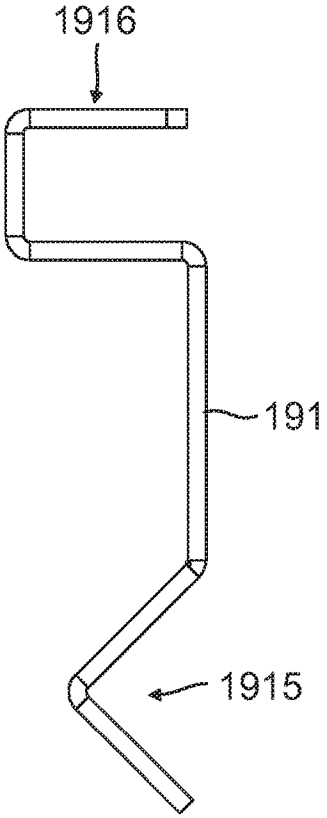
FIG. 19B is an end view of the angle panel clamp of FIG. 19A.
Figure 19A:
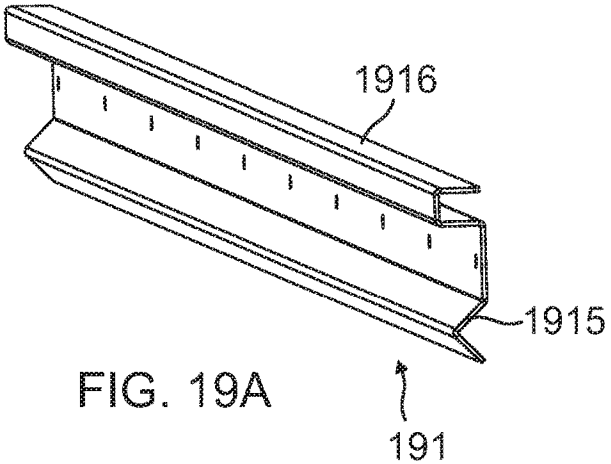
FIG. 19A is a perspective view of the angle panel clamp shown in FIGS. 18A-18D.

Elongated clamp element 191 is shown in perspective in FIG. 19A and in end view in FIG. 19B. Two of these clamp elements are employed, along with appropriate hardware, such as a bolt and wingnut 1912, for example, for either the outside corner (FIG. 18B) and the inside corner (FIG. 18D).

For the outside variable angle corner 181 of FIGS. 18A and 18B, a panel 1812 (FIG. 18F) and a panel 1811 (FIG. 18E) are butted together with their sharp hook edges 1813 and 1814 touching. Then two clamp elements 191 are placed in facing relationship with reverse bend ends 1915 enclosed around the inside of hook ends 1813 and 1814, as shown in FIG. 18B. Wingnut 1912, together with suitable bolt-type hardware, are then used to secure hook edges 1813 and 1814 together. As shown in FIG. 18B, this combined corner panel assembly has an included possible angle ranging from about 90° to about 180°, being shown here with an exemplary angle of about 135°.

Similarly, the other, or hook, ends 1916 of clamp element 191 are used in a similar manner to form insider corner 182 as shown in FIG. 18D. Sharp hook edges 1813 and 1814 are butted together but with panels 1811 and 1812 reversed so that the hooks are facing outward from the corner. Then hook ends 1916 (FIG. 19B) engage hook edges 1813 and 1814 as shown in FIG. 18D. The same hardware and wingnut engagement is made, as before, and the included possible angle of this arrangement is about 180° to about 270°.

It is quite evident how useful this corner angle flexibility can be when other than 90° corners are encountered when the present system is employed to construct a multi-direction wall or enclosure.

There are likely to be instances in practical situations where a temporary wall constructed according to this system and using at least some of the components disclosed will need to start at other than 90° from a wall. Variable angle right starter panel 195 is shown in FIG. 20. For reference, 90° fixed starter panel 106 is shown in FIGS. 1 and 4. The variable angle right starter panel is shown in detail in FIG. 20, and would replace panel 106 in right wing section 103, as seen in FIG. 1.

Figure 20A:
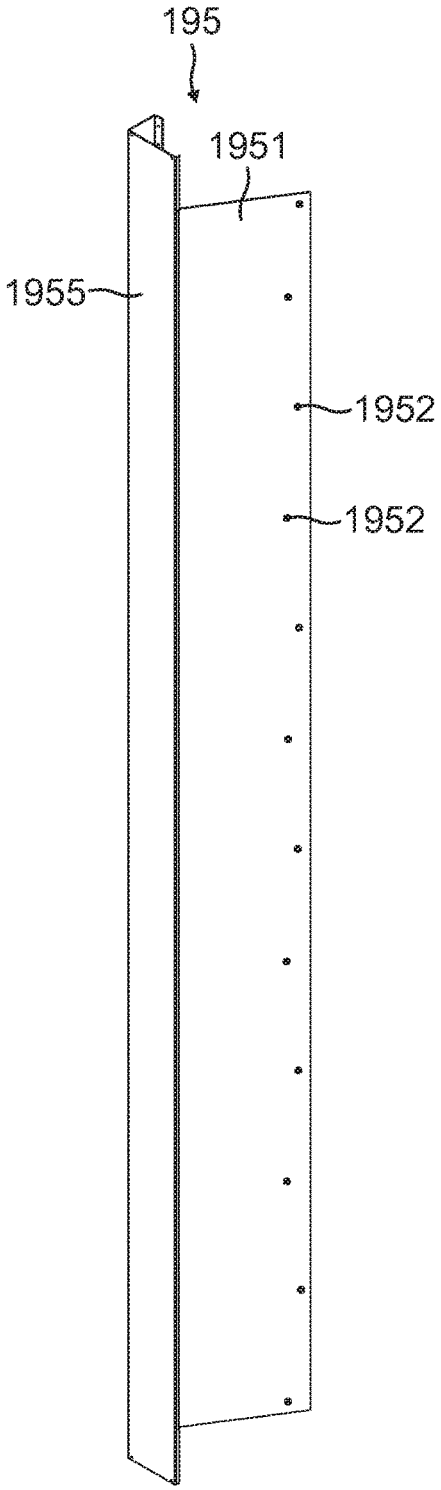
FIG. 20A is a perspective view of an alternative embodiment of a starter panel that can be employed with the FIG. 1 system, this being a variable angle right starter panel.
Figure 20B:
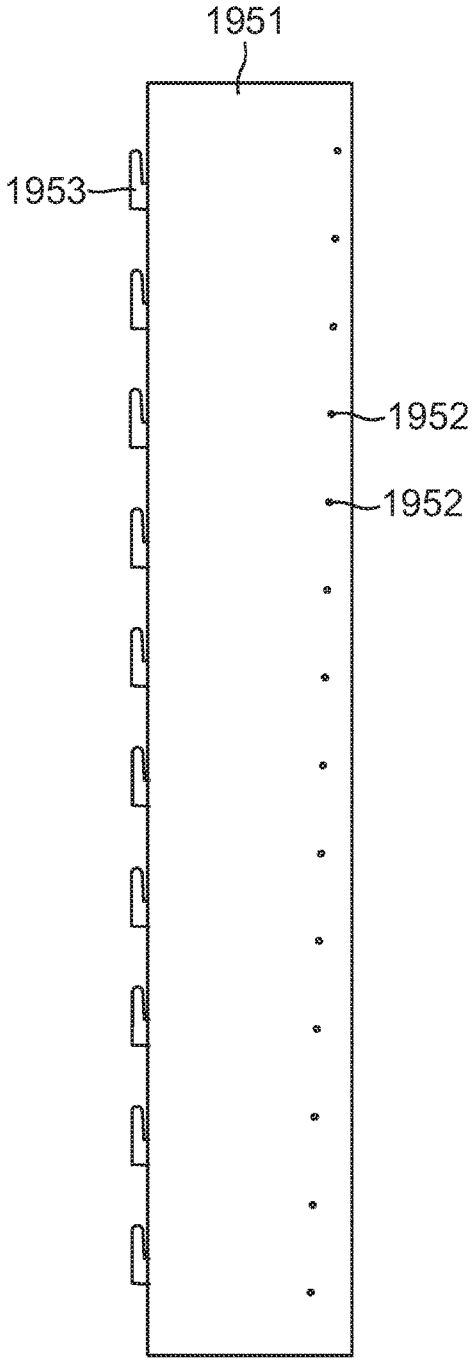
FIG. 20B is a front view of one element of the starter panel of FIG. 20A.
Figure 20C:
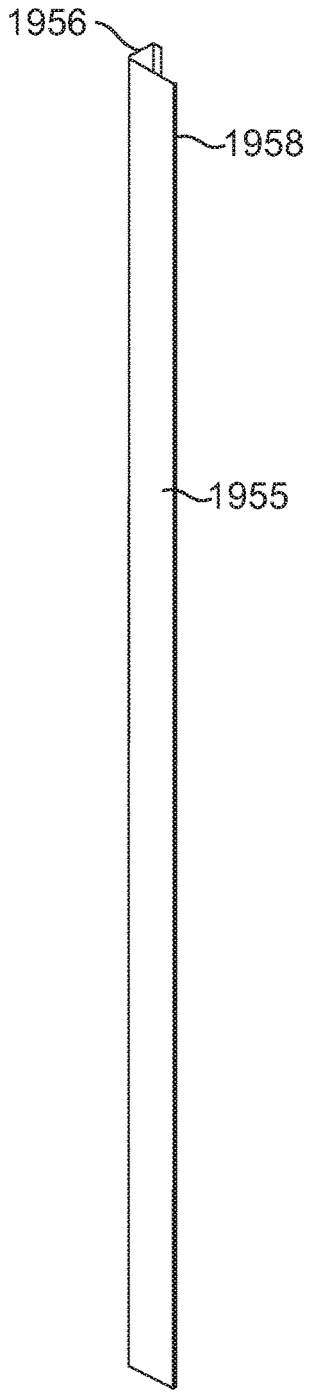
FIG. 20C is a perspective view of a second element of the starter panel of FIG. 20A.

Here the variable angle starter panel has two interconnecting elements, as shown in FIG. 20A. First is panel 1951 which is secured to the wall by means of nails, for example, through holes 1952. The holes may be pre-formed or created on the job. Panel 1951 is basically flat and has upwardly opening hook elements 1953 on the edge opposite to holes 1952, and is shown in front view in FIG. 20B.

Figure 20D:
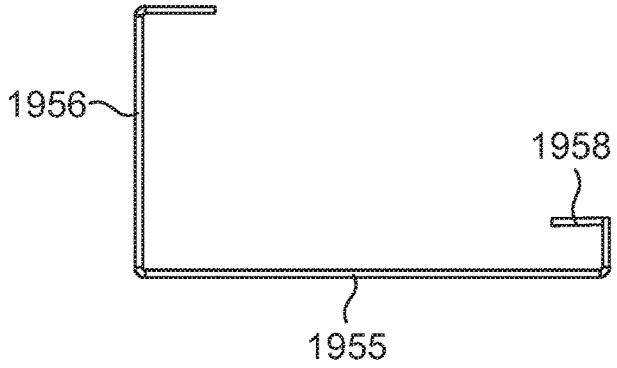
FIG. 20D is an end view of the element of FIG. 20C.

Elongated panel 1955 (FIG. 20C) has the end view shape shown in FIG. 20D. It can be seen that flange 1956 on one edge is formed to mate with the flange on one edge of a wall panel 105. Mating cutouts are formed in panel 1955 which engage the hook elements.

In the manner of the one-piece starter panel of FIGS. 1 and 4, panels 1951 and 1955 are coupled together and panel

1951 is secured to the location on a wall which has been chosen for the start of a wall to be constructed according to this system. It is noted that panel 1951 is a relatively thin sheet and that holes 1952 are along one edge. That leaves a slight amount of flexibility so that the hook-shaped edge flange 1958 is able to be engaged by hook elements 1953, which partially envelops the hook elements and can roll under the free edge of panel 1951 as panel 1955 rotates on the hooks of panel 1951.

As is easily perceived from FIG. 20, corner panel 195 can be secured to the wall and, at the same time, enables panel 1955, which would be secured to the adjacent panel 105, to swing through a relatively wide angle. For practical purposes, it is unlikely that the angle of a wall system structure, with respect to the building wall, would ever be as great as 45°, but such an angle is possible. Thus, the included angle of variable angle starter panel is 0° to 45°.

Figure 21A:
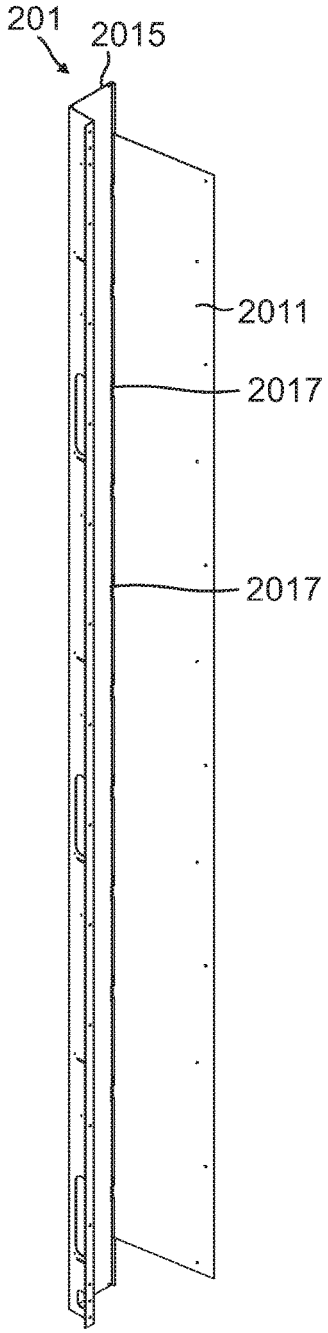
FIG. 21A is a perspective view of an alternative embodiment of a starter panel that can be employed with the FIG. 1 system, this being a variable angle left starter panel.
Figure 21B:
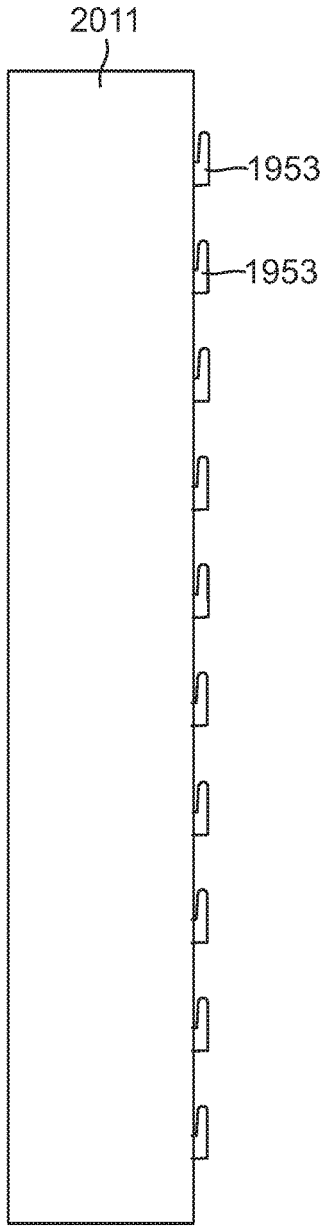
FIG. 21B is a front view of one element of the starter panel of FIG. 21A.

Variable angle left starter panel 201, shown in FIG. 21A, would replace starter panel 106 in left wing wall section 104 in FIG. 1. The elements of starter panel 201 are the same as those in FIG. 20, except that it is formed to mate with the other side edge of a panel 105.

Flat panel member 2011 would be the same as flat panel member 1951 if it is finished identically on both flat surfaces. Alternatively, it would be a separate, mirror image panel.

Figure 21C:
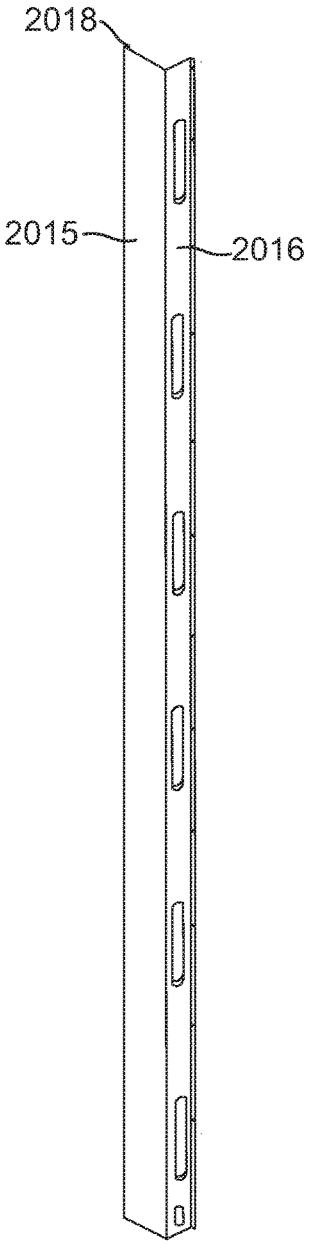
FIG. 21C is a perspective view of a second element of the starter panel of FIG. 21A.
Figure 21D:
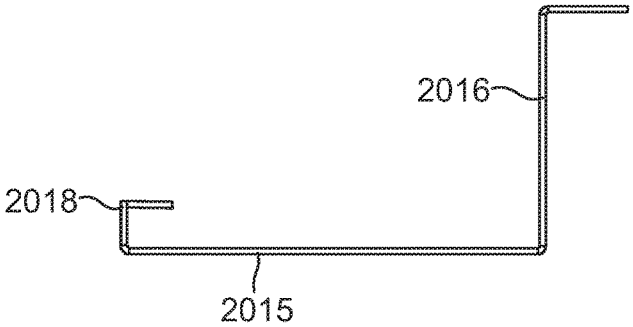
FIG. 21D is an end view of the element of FIG. 21C.

Elongated panel 2015 has the shape shown in FIGS. 21A and 21C, and in the end view, FIG. 21D. Flange 2016 is shaped to engage panel 105 in the left wing 104 of the wall system shown in FIG. 1. Hook shaped flange 2018 is formed with cutouts 2017 which are engaged by hooks 1953 in flat panel 2011 (1955).

The structure and use at the job site are the same for the FIG. 21 variable angle left starter panel 201 as for the variable angle right starter panel 195 in FIG. 20. There is no need to provide further details of this opposite side variable angle starter panel.

Figure 22:
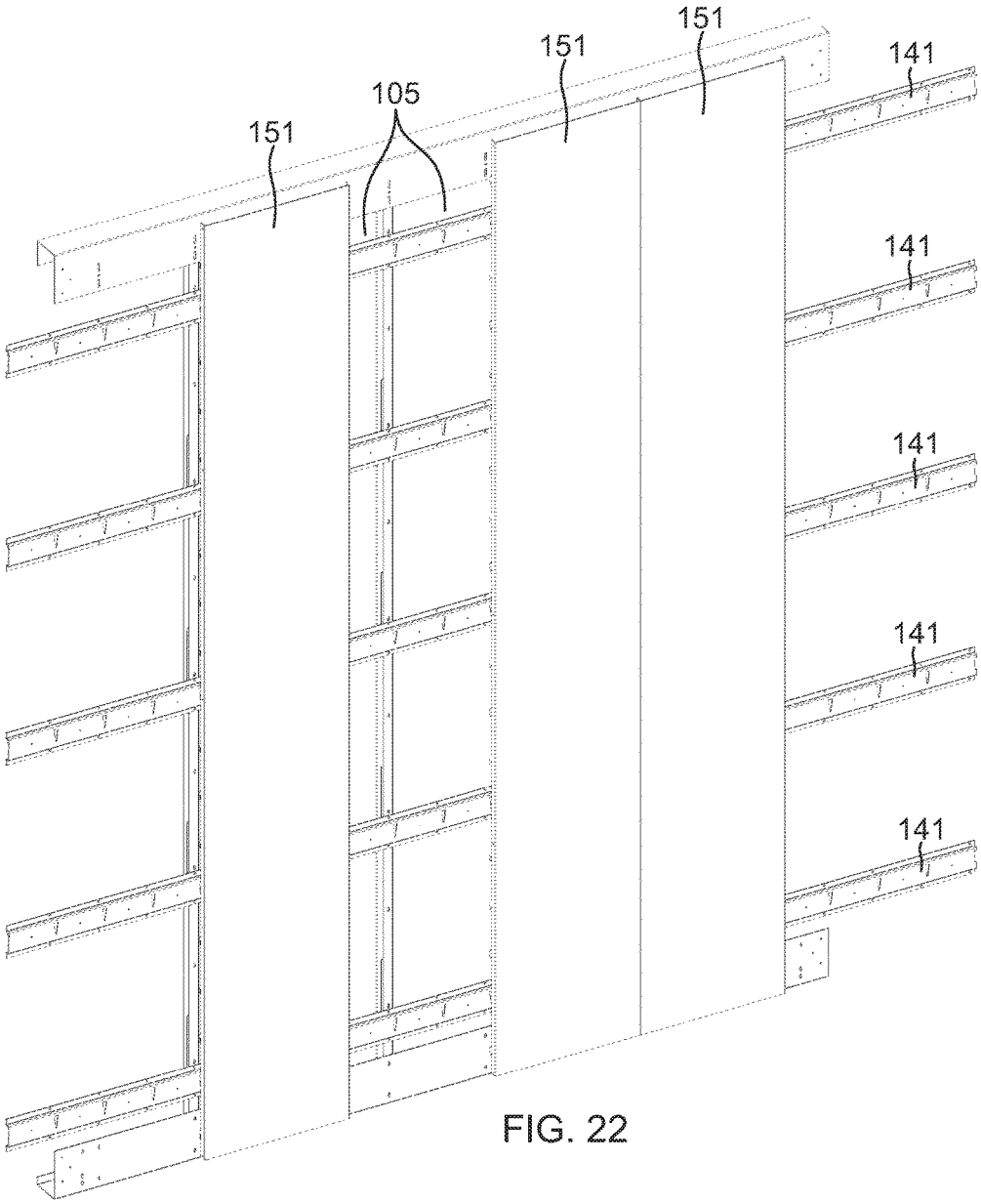
FIG. 22 is a partial perspective view of the interior finish panels of FIG. 8 mounted on the finish panel rails of FIG. 7 inside the wall panels of FIGS. 1 and 3.

FIG. 22 is provided to clarify the relationships between wall panels 105, finish panel rails 141, and interior finish panels 151. Front wall panels 105, as shown in FIG. 11, appear in FIG. 22 from their inside or back side. Finish panel rails 141 of FIG. 7 are attached to the back side of wall panels 105 by suitable hardware, as previously stated, and interior finish panels 151 are hung on rails 141 as shown in FIGS. 8 and 9.

The panels and other components and elements of this system are preferably made of metal. More particularly, the metal parts are preferably made with recyclable steel or aluminum. The panels are preferably powder coated. The preferred powder coating is mold resistant and provides a finish which can withstand nearly all elements, as well as being flame and corrosion resistant. The powder coating can also be antimicrobial and anti-graffiti.

As a matter of convenience, any one or more wall panels 105 can be separately removed and replaced. Such replacement might be desired in order to add a window, or a door assembly, or to use a different wall panel for any number of possible reasons.

What is claimed is:

1. A modular panel and component system from which a variety of structures with shapes characteristic of wall segments and enclosures may be rapidly assembled, the system comprising:

a plurality of elongated wall panels having rearwardly projecting flanges along the edges of the wall panels;

a plurality of elongated interior finish panel rails, each said interior finish panel rail having a plurality of tapered cutouts haying a first length, said cutouts being oriented perpendicular to the elongation of said rail;

a plurality of elongated interior finish panels, each having a finish surface and a flange projecting rearwardly away from the finish surface along each edge of the finish panel, each flange baying a plurality of hook elements projecting rearwardly away from the finish surface, each said hook having a length which is less than the first length of said cutout; and a multiplicity of connecting elements for connecting adjacent rearwardly projecting flanges of adjacent elongated wall panels and for connecting the interior finish panel rails to the rearwardly projecting flanges of the wall panels.

2. The system of claim 1, and further comprising at least one starter panel by which an end wall panel is configured to be attached to a building wall.

3. The system of claim 2, wherein said starter panel comprises:

a first variable angle panel member having a flange along one edge which is configured to engage with an adjacent wall panel and having a hook-shaped flange along an opposite edge;

a substantially flat panel adapted to be secured to a wall and having a plurality of upwardly angled hooks extending from one edge of said flat panel;

the hook-shaped flange of said first variable angle panel member having a plurality of cutouts therein configured to be engaged by said plurality of hooks on said flat panel;

whereby said first variable angle panel can be rotated with respect to said flat panel between 0° and 45°.

4. The system of claim 1, and further comprising at least one corner panel by which two adjacent wall panels are interconnected at an angle.

5. The system of claim 4, and further comprising at least one bottom corner element configured to receive the bottom edges of said corner panel.

6. The system of claim 5, wherein said bottom corner element is further configured to receive the bottom edges of said two adjacent wall panels.

7. The system of claim 4, and further comprising at least one top corner element configured to receive the top edges of said corner panel.

8. The system of claim 7, wherein said top corner element is further configured to receive the top edges of said two adjacent wall panels.

9. The system of claim 4, wherein said at least one corner panel comprises:

a first variable angle panel member having a flange along one edge which is configured to engage with an adjacent wall panel and having a hook-shaped flange along an opposite edge;

a second variable angle panel member having a flange along one edge which is configured to engage with an adjacent wall panel and having a hook-shaped flange along an opposite edge; and a panel clamp comprising:

a pair of clamp elements of identical shape, each having a first clamp end and different second clamp end; and connecting devices by which said clamp elements are secured together in paired relationship whereby said first clamp ends are configured to clamp together said first and second variable angle panels in a manner to enable said two panels to form subtended angles ranging from about 90° to about 180°, and said second clamp ends are configured to clamp together said first and second variable angle panels in a manner to enable said two panels to form subtended angles ranging from about 180° to about 270°.

10. The system of claim 1, and further comprising a bottom rail formed to receive bottom edges of a plurality of adjacent wall panels.

11. The system of claim 1, and further comprising a top rail formed to receive top edges of a plurality of adjacent wall panels.

12. The system of claim 1, and further comprising a door module assembly configured to connect to adjacent wall panels.

13. The system of claim 12, wherein said door module comprises a single door.

14. The system of claim 12, wherein said door module comprises a double door.

15. The system of claim 1, and further comprising a window module connectable on either side to adjacent wall panels.

16. The system of claim 1, and further comprising an adjustable horizontally sliding panel, said adjustable sliding panel comprising:

a first adjustable panel member having a plurality of spaced, securable connecting devices projecting from one surface of said first adjustable panel and having a flange along one edge thereof which is configured to engage with an adjacent wall panel; and a second adjustable panel member having a plurality of spaced slots configured for receiving a portion of each said projecting connecting devices, by which said first and second adjustable panels are securable together to form a panel of non-modular width, said second adjustable panel member having a flange along one edge thereof which is configured to engage with an adjacent wall panel.

* * * * *